US005544809A

United States Patent [19]

Keating et al.

[11] Patent Number: 5,544,809

[45] Date of Patent: Aug. 13, 1996

[54] HVAC CONTROL SYSTEM AND METHOD

[75] Inventors: Mark K. Keating, West Palm Beach; Fredrick J. Staudt, North Palm Beach, both of Fla.

[73] Assignee: Senercomm, Inc., Palm Beach Gardens, Fla.

[21] Appl. No.: 179,573

[22] Filed: Dec. 28, 1993

[51] Int. Cl.[6] ..... B01F 3/02

[52] U.S. Cl. ..... 236/44. C; 62/176.6; 236/47

[58] Field of Search ..... 236/47, 44 C, 236/46 R; 165/12; 62/176.6

[56] References Cited

U.S. PATENT DOCUMENTS 4,318,508 3/1982 Glasgow et al. ..... 236/47
4,659,009 4/1987 Newell III ..... 236/44. C
5,192,020 3/1993 Shah ..... 236/46. R
5,259,553 11/1993 Shyu ..... 62/176.6 X
5,297,396 3/1994 Kitamoto ..... 62/175

*Primary Examiner*—William E. Wayner
*Attorney, Agent, or Firm*—Allen, Dyer, Doppelt, Franjola & Milbrath, P.A. Attorneys at Law

[57] ABSTRACT

A system provides a flexible control of heating, ventilation and air conditioning (HVAC) for enclosed areas. The apparatus and method of the present invention measures selected internal environmental variables in the enclosed area including data from a motion sensor indicating the occupancy status of the area for automatically controlling the operation of the HVAC system. Control settings are made to meet desired temperature and energy consumption levels. A logic algorithm and microcomputer determine humidity levels. The humidity levels are controlled to minimize the occurrence of mold and mildew. Algorithm timing strategies optimize air drying initiated by an occupancy sensor.

20 Claims, 7 Drawing Sheets

| ROOM CONDITIONS | 75°F (24°C), 75% RH | | 75°F (24°C), 90% RH | |
|---|---|---|---|---|
| | LBS. | (kg.) | LBS. | (kg.) |
| WALLS, GYPSUM, PAINTED | 3.2 | (1.5) | 7.1 | (3.2) |
| ACOUSTICAL TILE CEILING | 2.2 | (1.0) | 3.9 | (1.8) |
| CARPET & PAD | 2.6 | (1.2) | 3.9 | (1.8) |
| VINYL TILE | 0.2 | (0.1) | 0.2 | (0.1) |
| POLYESTER / COTTON DRAPERIES | 0.4 | (0.2) | 0.6 | (0.3) |
| TOTAL MOISTURE ABSORBED BY MATERIALS | 8.6 | (3.9) | 15.7 | (7.1) |
| MOISTURE IN AIR 180# | 2.5 | (1.1) | 3.1 | (1.4) |

CALCULATED MOISTURE ABSORBED BY MATERIALS IN A 300 FT.$^2$ (28m$^2$) MOTEL / HOTEL ROOM

HVAC CONTROL SYSTEM AND METHOD

BACKGROUND OF THE INVENTION

1. Field of the Invention

The present invention relates generally to the control of heating, ventilating and air conditioning (HVAC) systems, and more particularly to a method and system for providing adaptable control of temperature and humidity for minimizing mold and mildew while reducing energy consumption.

2. Background Art

U.S. Pat. No. 5,170,935 issued to Federspiel et al. on Dec. 15, 1992 discloses an adaptable control of HVAC systems which regulates environmental conditions within an enclosed area. The apparatus and method described measures selected environmental variables in the enclosed area, calculates a value of a comfort index which is a function of the values of the selected environmental variables and a plurality of parameters that predicts a thermal sensation rating of an occupant. The system receives a sensation rating from the occupant and compares it to the predicted thermal sensation rating to determine a difference. A parameter estimation process estimates the value of at least one parameter and changes the value to reduce the difference between the sensation ratings if necessary or desired. The process is repeated until the sensation difference is substantially eliminated. Federspiel '935 recognizes the need for thermal comfort and point out that thermal comfort is primarily dependent upon whole body thermal sensation which is a function of six variables including air temperature, humidity, air velocity, clothing insulation, bodily heat production rate, and mean radiant temperature. Federspiel '935 teaches a direct contact by a human occupant to determine the occupants perceived comfort level.

U.S. Pat. No. 4,889,280 issued to Grald et al. on Dec. 26, 1989 discloses a temperature and humidity auctioning control adapted to be connected to a thermostat control which includes a temperature sensor that provides a sensed temperature signal. The auctioning control for humidity and temperature is completed without a separate humidity controller and provides humidity control information to the thermostat. A space temperature setpoint is lowered by a precise amount needed to achieve proper humidity control.

Various methods and devices have been used to control a space environment by focusing on control of one or a combination of a cooling zone, a dehumidifying zone and a fan or air flow zone. By way of example, U.S. Pat. No. 4,271,898 issued to Freeman on Jun. 9, 1981 discloses an economizer comfort index control which includes a control relay activated when the thermostat selector switch is in the cool position and the fan selector switch in on to cause the blower motor to run at a high speed while the compressor is running and at a low speed while the compressor is not running. A relative humidity controller makes the HVAC system responsive to relative humidity as well as temperature for maintaining an acceptable nighttime comfort index while reducing energy usage by the HVAC system. In other words, humidity control is essentially accomplished by increasing speed control of the fan rather than lowering the temperature of the space with the thought of conserving energy.

Occupancy-sensing setback controllers have been used in hotel rooms and other applications since the 1970's. The extent of the setback is limited in coastal and sub-tropic climates due to the potential for mold and mildew damage caused by high relative humidity. There has been developed and is now in production a microcomputer-based, occupancy-sensing setback controller which senses relative humidity in addition to temperature. Because of the power of the onboard microcomputer, a psychrometric algorithm using the thermodynamic states of temperature and relative humidity has been developed. This algorithm can maximize the extent to which the HVAC can remove moisture from the room when it is damp, thereby reducing furniture, fixtures and equipment damage, yet when the room is dry, an energy-saving setback temperature cycle can be utilized.

The typical occupancy-sensing setback controller operates with a very simple control algorithm based on temperature only. When the room is unoccupied (door closed, no motion detected), the HVAC's conventional thermostat is disabled until the room temperature reaches either the summer or winter setback temperature selected at the setback controller. When this setback temperature is reached, the HVAC is enabled until the room temperature decreases (or increases) approximately 2° F. Thus, if the room heat load is such that the room heat load is such that the room never reaches the setback temperature, then the HVAC remains disabled until the room is reoccupied (door closed, motion detected). This period will often occur when room conditions are very favorable to the growth of mold and mildew.

More advanced occupancy-based setback controllers are designed with an on-board microcomputer which greatly increases the flexibility that can be designed into the control algorithm. Some of the features include the ability to differentiate between interior and exterior door control responses, provide room refresh cycling to avoid stagnant air build-up during the room occupant's absence and the ability to bypass the controller in a non-regressive fashion. An automatic unsold mode which allows increasing the summer setback temperature to 85° F. (and a winter setback temperature of 55° F.) is also available. When servicing the unsold room, the maid blocks the door open. This allows the HVAC to operate during servicing but retains the unsold setback temperature when the maid leaves the room and closes the door. There is also an out-of-service mode available which has temperature setbacks of 96° F. summer (40° F. winter). This mode is for rooms that are not used due to maintenance or low seasonal occupancy. Although the auto unsold and the out-of-service modes save additional energy, they also will encounter extended periods when the room conditions will be very favorable to the growth of mold and mildew. Thus, an algorithm capable of avoiding the environmental regions favorable to the growth of mold and mildew is needed for many property locations.

The staff at the University of Florida's Institute of Food and Agricultural Sciences has broadly defined the "mold and mildew zone" as the psychrometric region above 72° F. and above 60% relative humidity. Efforts to avoid the mold and mildew zone by lowering the temperature below 72° F. can also be unsatisfactory if the outside dew point temperature is greater than the room temperature. If, when the door is opened, the in-rushing outside air is at a high dew point temperature, condensation will occur on the room furnishings, walls and windows. This moisture will become imbedded and take a long time to be removed when the room is warmed, thus becoming another incubation site for mold and mildew. In addition, the condensation will cause corrosion on brass and other metallic surfaces, particularly in coastal regions. There is therefore a need for an effective control algorithm that uses the HVAC to escape the mold and mildew comfort zone without reducing room temperature to the point where condensation occurs. Using an occupancy-sensing setback controller to reduce electrical costs when the room is unoccupied and/or unsold can subject the room to nearly ideal conditions for mold and mildew growth, unless the control algorithm is capable of accounting for room relative humidity as well as temperature.

SUMMARY OF INVENTION

A system for controlling HVAC in an enclosed space includes means for determining occupancy status of the enclosed space and delivering a signal indicating an unoccupied condition. The system comprises means for sensing temperature in the space and providing a signal corresponding to the sensed temperature, and means for sensing relative humidity in the space and providing a signal corresponding to the sensed relative humidity. Means for comparing the sensed temperature to a predetermined temperature and provides a first enabling condition signal representative of a difference between the sensed and predetermined temperatures. Means for comparing the sensed relative humidity to a predetermined relative humidity provides a second enabling condition signal representative of a difference between the sensed and predetermined humidity. Finally, means for enabling the HVAC brings the room temperature and relative humidity to a predetermined temperature and relative humidity. The enabling means is responsive to the unoccupied condition signal in combination with one of the enabling condition signals.

In another embodiment of the invention, the system further comprises means for providing a lapsed time period signal. The lapsed time period is initiated by the unoccupied signal for starting the time period to a predetermined lapsed time period for negating the time period signal. The negated time period signal provides a third enabling condition signal.

In one embodiment of the invention, the HVAC enabling means comprises a thermostat for setting the predetermined temperature and monitoring room temperature. The thermostat provides a forth enabling condition signal when the room temperature exceeds the predetermined temperature.

In the preferred embodiment of the invention, the occupancy status means comprises a motion detector operating in combination with a space entrance door closed condition for providing the unoccupied condition signal.

In addition, a method for controlling an enclosed space environment is presented. The method comprises the steps of determining occupancy status of the enclosed space and delivering a signal indicating an unoccupied condition, sensing temperature in the space and providing a signal corresponding to the sensed temperature, sensing humidity in the space and providing a signal corresponding to the sensed relative humidity, comparing the sensed temperature to a predetermined temperature and providing a first enabling condition signal representative of a difference between the sensed and predetermined temperatures, comparing the sensed humidity to a predetermined humidity and providing a second enabling condition signal representative of a difference between the sensed and predetermined humidity, and enabling an HVAC system cooperating with the space for bringing the room temperature and the room humidity to a predetermined temperature and humidity, the enabling step responsive to the unoccupied condition signal in combination with one of the enabling condition signals.

An alternate method further comprises the step of providing a lapsed time period signal. The lapsed time period signal is initiated by the unoccupied signal for starting the time period to a predetermined lapsed time period for negating the time period signal. The negated time period signal provides a third enabling condition signal.

In one embodiment of the invention, the method includes the step of enabling the HVAC system by setting a thermostat to the predetermined temperature, monitoring room temperature, and thus providing a forth enabling condition signal when the room temperature exceeds the predetermined temperature.

In the preferred embodiment, the step of determining occupancy status comprises operating a motion detector in combination with a space entrance door closed condition for providing the unoccupied condition signal.

It is an object of the invention to maintain temperature comfort in the space when the space is occupied and do so with energy conservation techniques during periods when the space is both occupied and unoccupied. In addition, it is an object of the invention to reduce the growth of mold and mildew which results in potential damage to space furnishings as well as discomfort to an occupant. It is yet another object of the invention to provide moisture removal to the space with energy savings without the need of controlling a thermostat and without the knowledge of the HVAC system sensible and nonsensible heat removal capability.

It is a particular object of the invention to provide a psychrometric control algorithm for maintaining the space environment outside established mold and mildew preferred growth zones and to further use such an algorithm to operate a microcomputer for controlling a space HVAC system in maximizing the potential for removing moisture from the space environment while at the same time providing energy savings accepted as significant savings to those knowledgeable in the art of HVAC systems control.

BRIEF DESCRIPTION OF DRAWINGS

A preferred embodiment of the invention as well as alternate embodiments are described by way of example with reference to the accompanying drawings in which.

FIG. 4 and 4*a* are functional flow diagram illustrating the algorithm logic employed by the microcomputer shown in FIG. 1.

DETAILED DESCRIPTION OF PREFERRED EMBODIMENT

Figures 1, 3:
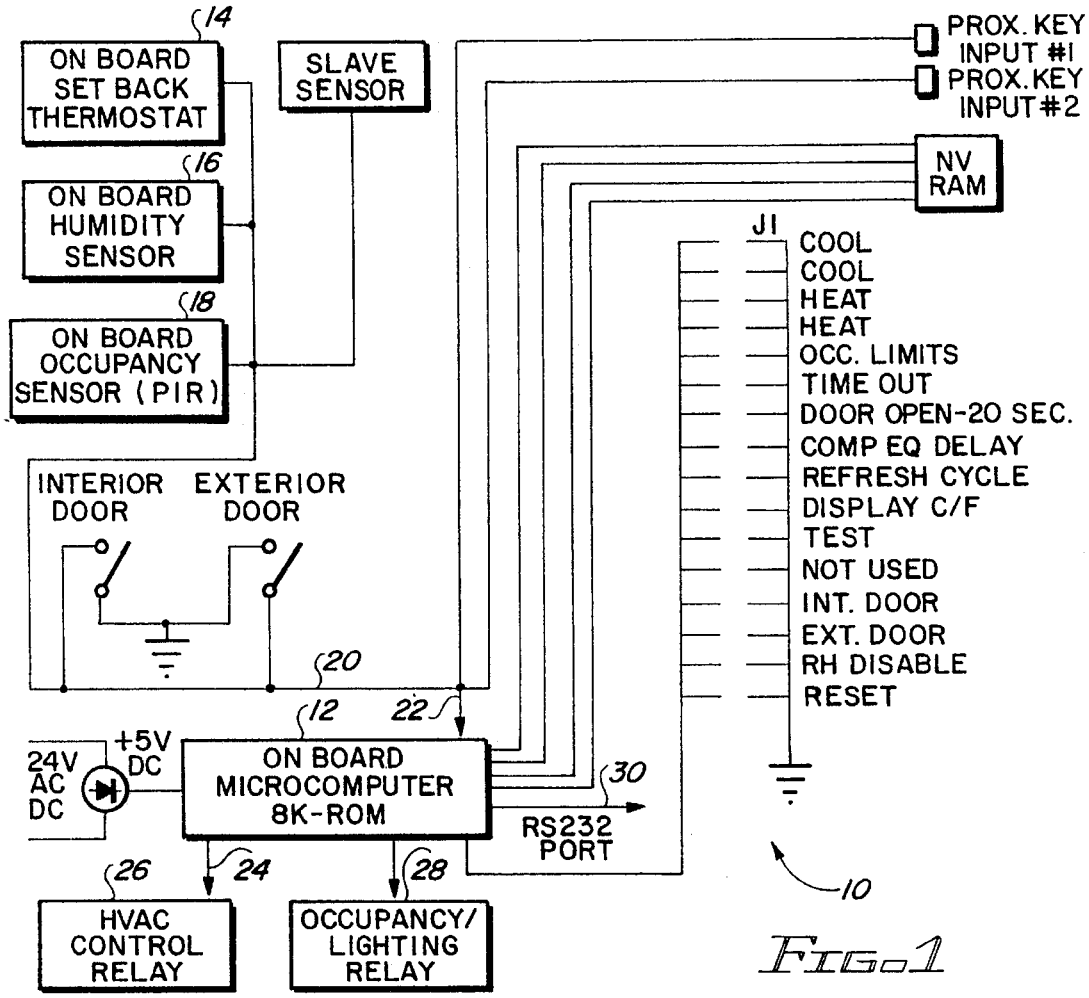
FIG. 1 is a functional block diagram illustrating components of/the preferred embodiment of the invention.
FIG. 3 is a table illustrating moisture absorbed by materials under one temperature and two relative humidity room conditions.

The preferred embodiment of the invention, a system for controlling HVAC in an enclosed space is illustrated in functional block diagram form in FIG. 1. The HVAC system controller 10 comprises a microcomputer 12 which receives input data signals from a temperature 14, humidity 16 and occupancy 18 sensor located within the control package of the preferred embodiment. As added indicators in determining occupancy, entry in and out of the room is monitored by door and key switches for providing door status condition signal 20 to the microcomputer 12. As will later be described in greater detail, the microcomputer software is programmed to logically evaluate the input data 22 for providing an output control signal 24 to an HVAC control relay 26 or to other systems such as lighting circuitry 28 used for predetermined occupancy conditions. An RS232 signal output 30 is provided in the preferred embodiment for serial data communication with a global processor used in monitoring a multiplicity of space environmental conditions. Such monitoring is currently employed by hotel and dormitory complexes.

Before describing the logic used in the microcomputer control algorithm, operating characteristics of the invention and conditions anticipated will be described to better appreciate the specific needs satisfied by the controller 10. Unlike a thermostat, the controller governs the HVAC system's conventional thermostat within a limited temperature range. By way of example, if a hotel guest leaves a room thermostat set at 80° F. (summertime condition) and the controller 10 tries to control to 78° F. temperature level, the HVAC system would not be turned on by the controller 1O since the room thermostat is set at a higher temperature than the controller 10. Therefore, the control algorithm must account for the fact that the room thermostat may turn off the HVAC system before the controller 10 sends a signal 24 to the HVAC control relay 26 turning off the HVAC system.

In addition, the controller 10 is placed in a living space without any knowledge of the capability of the HVAC system or of the sensible or non-sensible heat loads likely to be imposed upon the space. By way of example, some hotel or motel rooms have oversized HVAC systems that cool the room with little moisture removal. In other rooms, the HVAC system may be so undersized that it runs continuously to just maintain a room temperature at 80° F.

The potential for an HVAC system to remove moisture from the air is represented by its sensible heat factor (SHF). The SHF value for any given set of operating conditions is realized after the HVAC system has been allowed to operate long enough to achieve steady state conditions. When the HVAC system is first turned on, the SHF is essentially 100%. As HVAC system coils and fins cool down, condensation of moisture from incoming room air is initiated.

Figure 2:
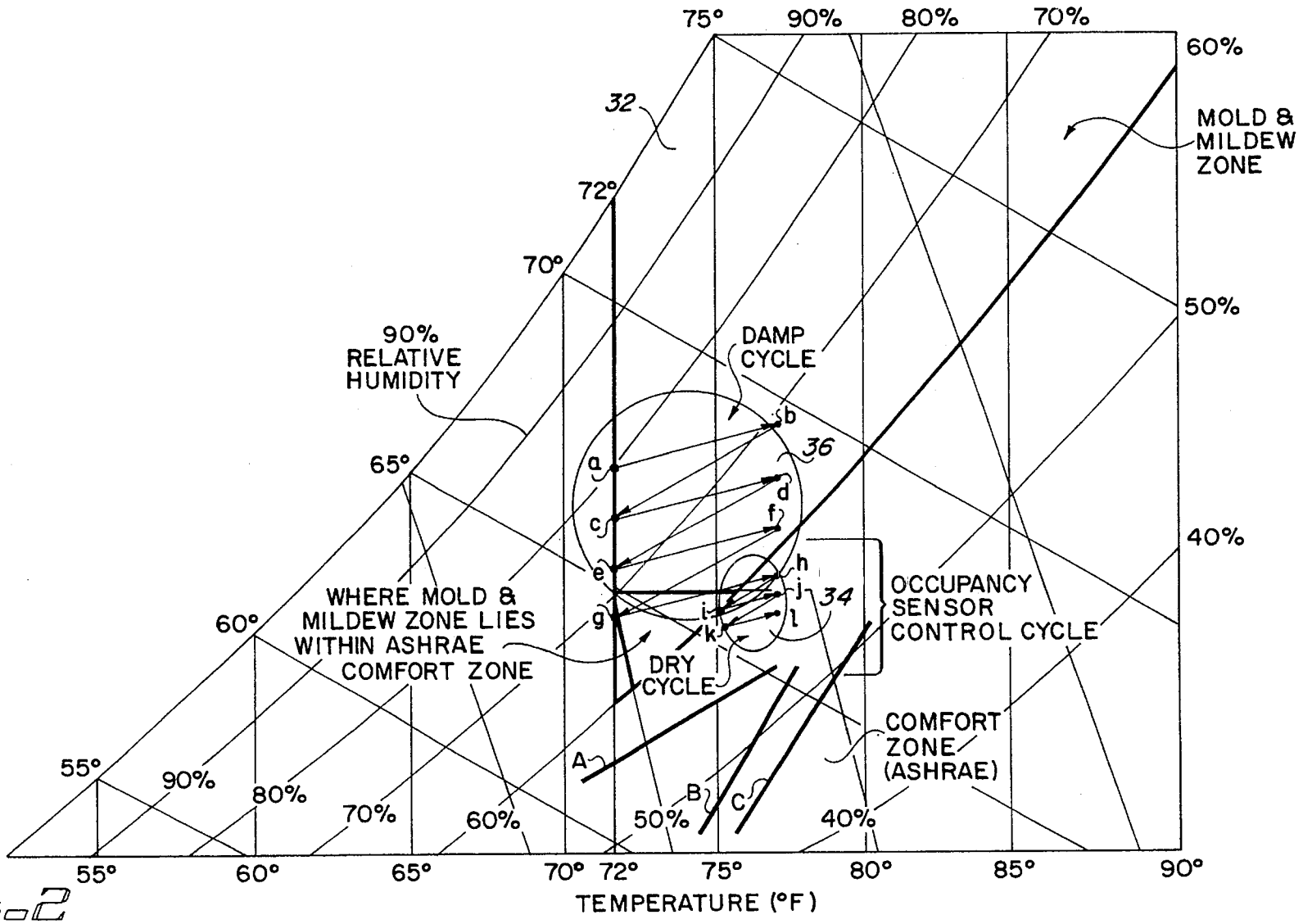
FIG. 2 is a psychrometric plot of temperature and relative humidity illustrating a currently accepted mold and mildew zone/as well as an ASHRAE comfort zone.

These examples of conditions encountered by the controller 10 provides insight into the boundaries placed on the control algorithm. In other words, the algorithm accounts for unknown thermostat setting; HVAC fan conditions (on, off, speed); cool down speed of space; moisture migration (in and out of space); and the time space environment remains in a mold and mildew growth condition. The algorithm does not act directly on the value of relative humidity since the relative humidity can either increase or decrease when the HVAC system is activated. With reference to FIG. 2, a psychrometric plot of temperature and relative humidity, locus lines "A", "B", and "C" are examples of actual hotel room conditions produced by a room HVAC system. Line "A" shown the relative humidity increasing as the temperature decreases in a hotel room during evening hours when the sensible heat load was low (i.e. small percentage of time when refrigeration in operation). Lines "b" and "C" illustrate two other rooms operating conditions. In these rooms, relative humidity decreases as temperature decreases. Therefore, if the algorithm were to act directly on relative humidity, rooms under conditions similar to that illustrated in "A" would be out of control.

Testing on rooms under the conditions of lines "B" and "C" also showed relatively humidity control alone, set at 58% humidity, was unsatisfactory. Data recorded within guest rooms indicate that the air relative humidity is reduced rapidly once the HVAC system is enabled. When the relative humidity is reduced below 58%, the HVAC system is enabled. The relative humidity then rises above 60% rapidly, and the HVAC system is almost immediately reactivated. The HVAC system tends to be cycled very rapidly, and doing the opposite of what is desired from an efficient moisture removal point of view. The coils are never completely cooled to their point of maximum moisture removal efficiency. Another difficulty occurs in very damp rooms when the HVAC system cannot pull the relative humidity down to a preset point. In this case, the HVAC system runs continuously, no energy savings is achieved, and the room is still in a mold and mildew growth condition, if the thermostat is satisfied at a preset point above 72° F.

Currently, staff at the University of Florida, Institute of Food and Agricultural Sciences has broadly defined a mold and mildew zone 32 as the psychrometric region above 72° F. and above 60% relative humidity as graphically illustrated in FIG. 2.

It has also been observed that not only does the relative humidity and temperature both decrease when the HVAC system is enabled, but when the system is disabled, both relative humidity and temperature increase. The three most likely scenarios implied by these observations are:(1) a room is poorly insulated against heat and moisture infiltration;(2) an overall wall opening or continuously running fan condition exists; and (3) room furniture and fixtures are moist and give up this moisture at a slower rate than the air being circulated through the HVAC system coils. Several rooms ranging from damp to dry conditions have been studied. The results shown characteristically that the more likely scenario is the one where moisture in the furnishings is being emitted into the room (i.e. 3 above). The results of Virginia Peart, Ph.D. published in 1989 in "Managing Moisture and Mildew in Hotels and Motels" and "Mildew and Moisture Problems in Hotels and Motels in Florida". *Home Economics*, University of Florida, Institute of Food and Agricultural Sciences, Gainesville, Florida, show that significant quantities of moisture are trapped in typical hotel furnishings as further illustrated in Table 1. It appears important therefore to lower the room air relative humidity low enough to encourage the out gassing of moisture from furnishings before a significant decrease in relative humidity can be realized.

Again with reference to FIG. 2, a comfort zone 38 has been defined by the American Society of Heating, Refrigeration and Air Conditioning Engineers, Inc. (ASHRAE). The algorithm in the preferred embodiment of the controller 10 is designed to have the HVAC system run on a dry cycle 34 and a damp cycle 36 depending on conditions in the room. In the preferred embodiment, the dry cycle is a temperature setback cycle where the control band imposed on a thermostat is 2° F. The damp cycle is initiated when room relative humidity is above 60% relative humidity. The HVAC system and the controller 10 work together as one system to efficiently remove moisture. The goal of the damp cycle is to get room conditions out of the mold and mildew growth area 32 either by reducing temperature to below 72° F. or by repetitively cycling the room HVAC system to move the room condition out of the area 32. Ultimately, bringing and maintaining the room within the comfort zone 38 is one objective to be completed.

Again with reference to FIG. 2, and by way of example, the damp cycle 36 would include a room condition heating up from point "a" to point "b". The HVAC system is enabled and the room condition moves from "b" to "c" a point at 72°

F. The room is allowed to increase in temperature to point "d" and again the HVAC system is enabled removing moisture until a temperature of 72° F., or point "e" on the plot. Thus this cycle continues ("e" to "f", "f" to "g") until room conditions are out of the defined mold and mildew zone 32 ("h") at which time the dry cycle 34 is implemented. The dry cycle 34, by way of illustrated example, enables the HVAC system to move room conditions from"h" to "i" as illustrated in FIG. 2 where the temperature is allowed to drop by 2° F. as described above. The dry cycle 34 will continue "j" to "k", "k" to "l", etc. as long as the room conditions are out of the mold and mildew zone 32.

Figure 4:
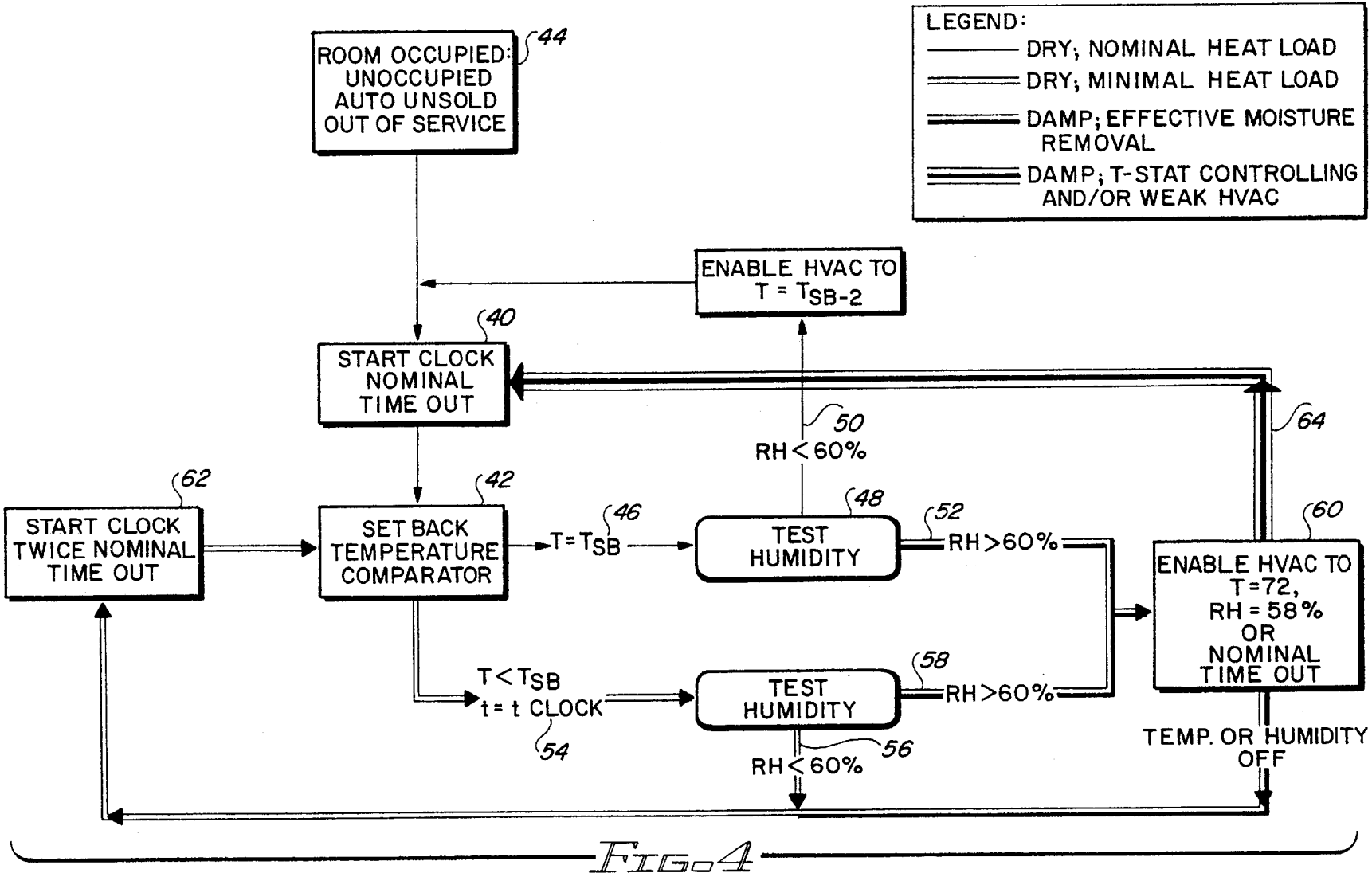
Figure 4A:
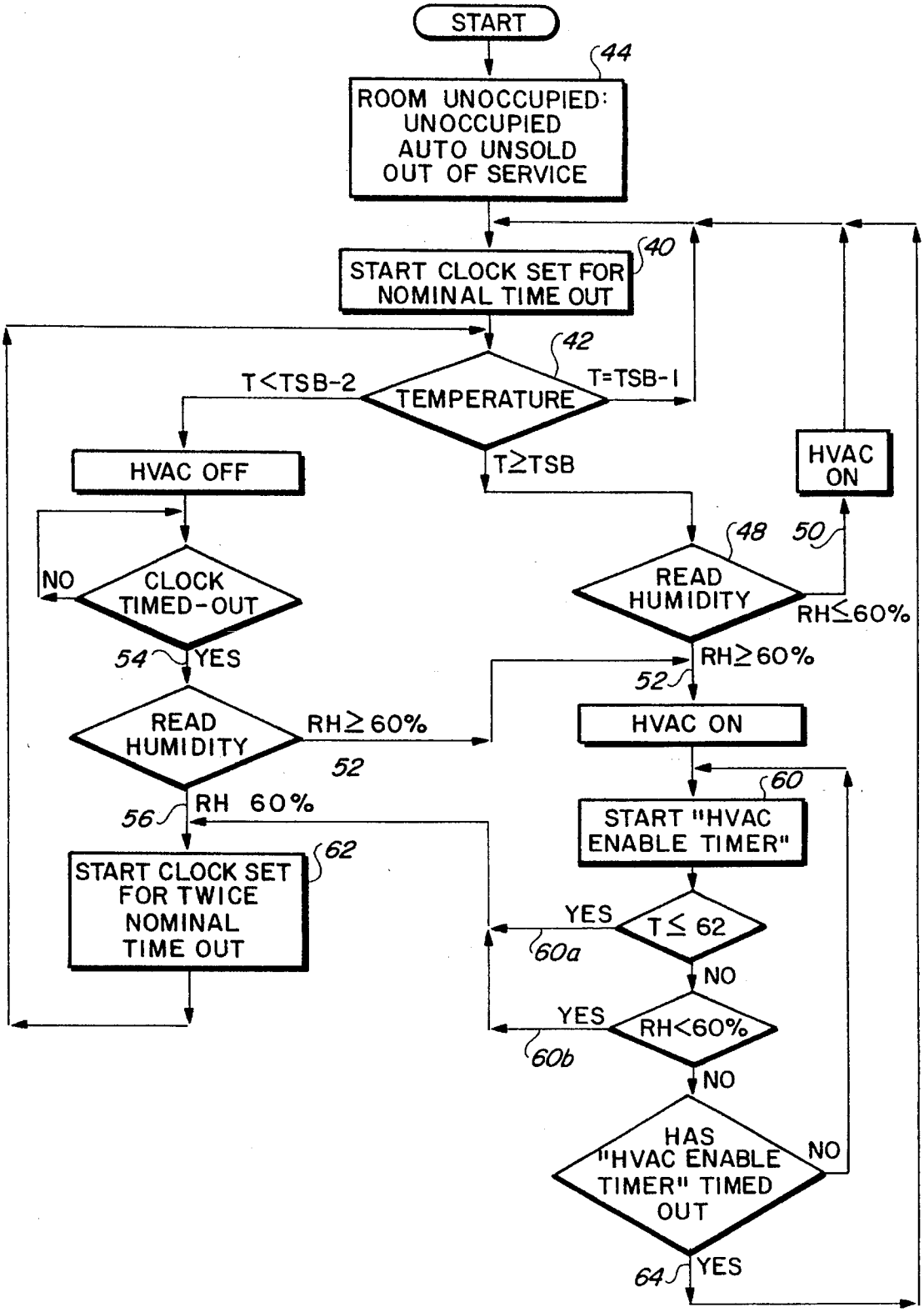
FIG. 4*a* is the flow diagram of FIG. 4 using a standard flow chart format.

With reference to FIG. 4 and 4*a*, a functional flow diagram illustrating the algorithm logic in the preferred embodiment, the controller 10 has separate responses as earlier described with reference to FIG. 2, a dry cycle 34 and a damp cycle 36, to a dry room condition respectively and a damp condition. When a room is initially placed under command of the controller 10, a clock with a nominal time out condition 40 (for example, one hour period), room temperature "T" and setback temperature $T_{SB}$ are monitored and compared as illustrated at numeral 42 of FIG. 4. The room is placed under command of the controller 10 when the room is in an unoccupied condition 44, unsold or out of service. As illustrated in FIG. 1, an onboard occupancy sensor 18 provides an unoccupied status to the microcomputer 12. If the room is seeing a significant heat load, the room temperature T rises to the preset setback temperature "$T_{SB}$" as illustrated in FIG. 4 at temperature condition 46 ($T=T_{SB}$). Humidity is compared 48 to predetermined humidity values defining dry 50 (less than or equal to <60% relative humidity) and damp 52 (greater than 60% relative humidity). If the room is dry 50, the dry cycle 34 described earlier and illustrated in plot of FIG. 2 is initiated wherein the room temperature is cycled over a 2° F. band. If the room is not sensing a significant heat load ($T<T_{SB}$), the temperature "T" will not reach the setback temperature $T_{SB}$ before the clock time period runs out, condition 54. If the preselected time period 40 runs out (t=t clock), and if the room is dry 56 (RH<60%), there is no need to use energy to enable the HVAC system and the clock 40 is restarted. If the room is damp (RH>60%) at either the setback temperature $T_{SB}$, illustrated at condition 52 or when time period occurs t=t clock, illustrated at condition 58, a cycle 60 to retard mold and mildew is initiated. The purpose of this retarding cycle 60 is to retard mold and mildew growth by removing moisture or by reducing the temperature to 72° F., or the combination as described earlier. By way of example, this cycle 60 is accomplished by enabling the HVAC system as illustrated at 60 in FIGS. 4 and 4*a* until one of the following conditions occurs:

1. room temperature is reduced to 72° F.;
2. relative humidity is approximately 58%; or
3. one hour elapses. The room conditions, temperature and relative humidity values herein described are used to establish preset conditions to describe the invention, but it is anticipated that any preset condition can be implemented based on standards and conditions in a particular space or environment.

If either the temperature 60*a* or relative humidity 60*b* conditions above are met as illustrated with reference to FIG. 4*a*, one can assume that the room has a good HVAC system or that the thermostat is set low. In this case, the clock is restarted 62 with twice the nominal time out period 40. This will allow time for the room to psychrometrically drift outside the mold and mildew area 32. Within a few cycles, the room will be dry and the energy saving dry cycle initiated.

If, on the other hand, the time out period lapses while in cycle 64, the room probably has a weak HVAC system, a high setting on the thermostat, or both. In this case, it is assumed that less moisture is removed, so the clock is restarted with the nominal time out period 40 as more cycles are assumed to be required before the room becomes dry.

The clock 40 time period function permits the algorithm to perform its control logic function without knowledge of a thermostat setting and to control the amount of time that the room will be allowed to drift (nominal 40 and extended 62) into the mold and mildew area 32. The algorithm uses a double test on temperature and relative humidity to decide when it should run a damp cycle 36 to control mold and mildew or dry cycle 34 for maximum energy savings.

Figure 5A:
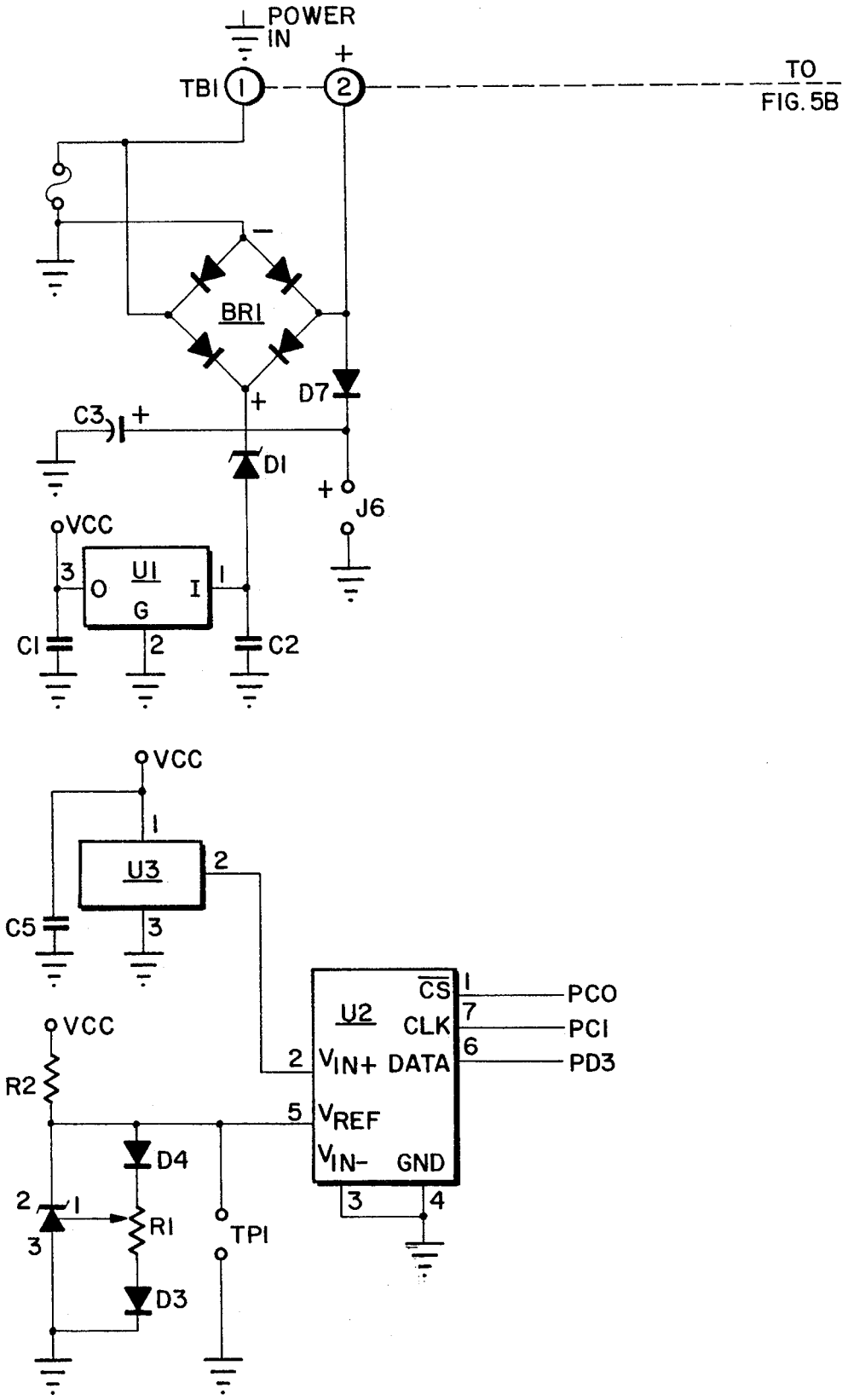
FIG. 5 is a schematic circuit diagram illustrating electronic elements used in the preferred embodiment described in FIG. 1.
Figure 5B:
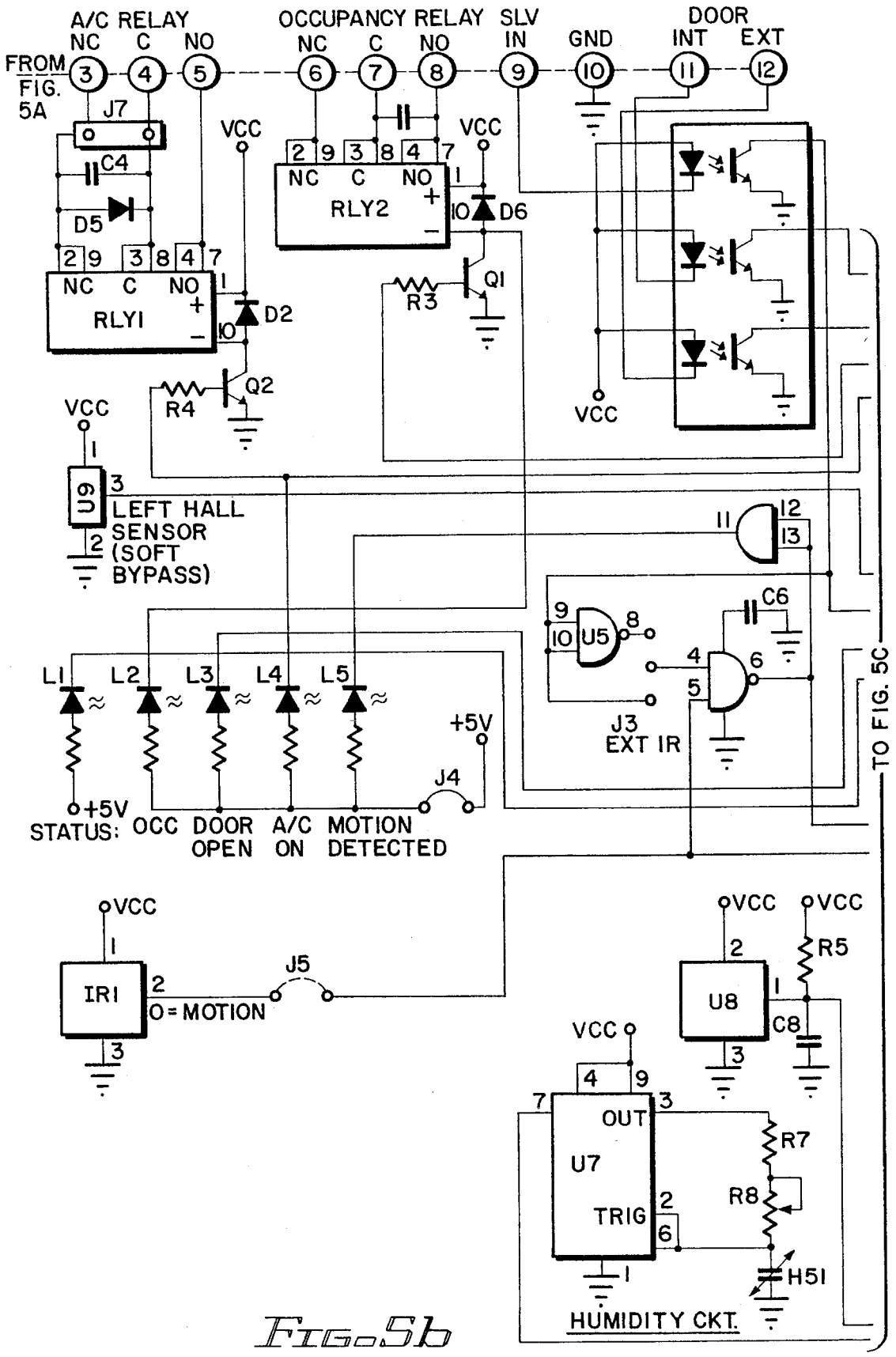
Figure 5C:
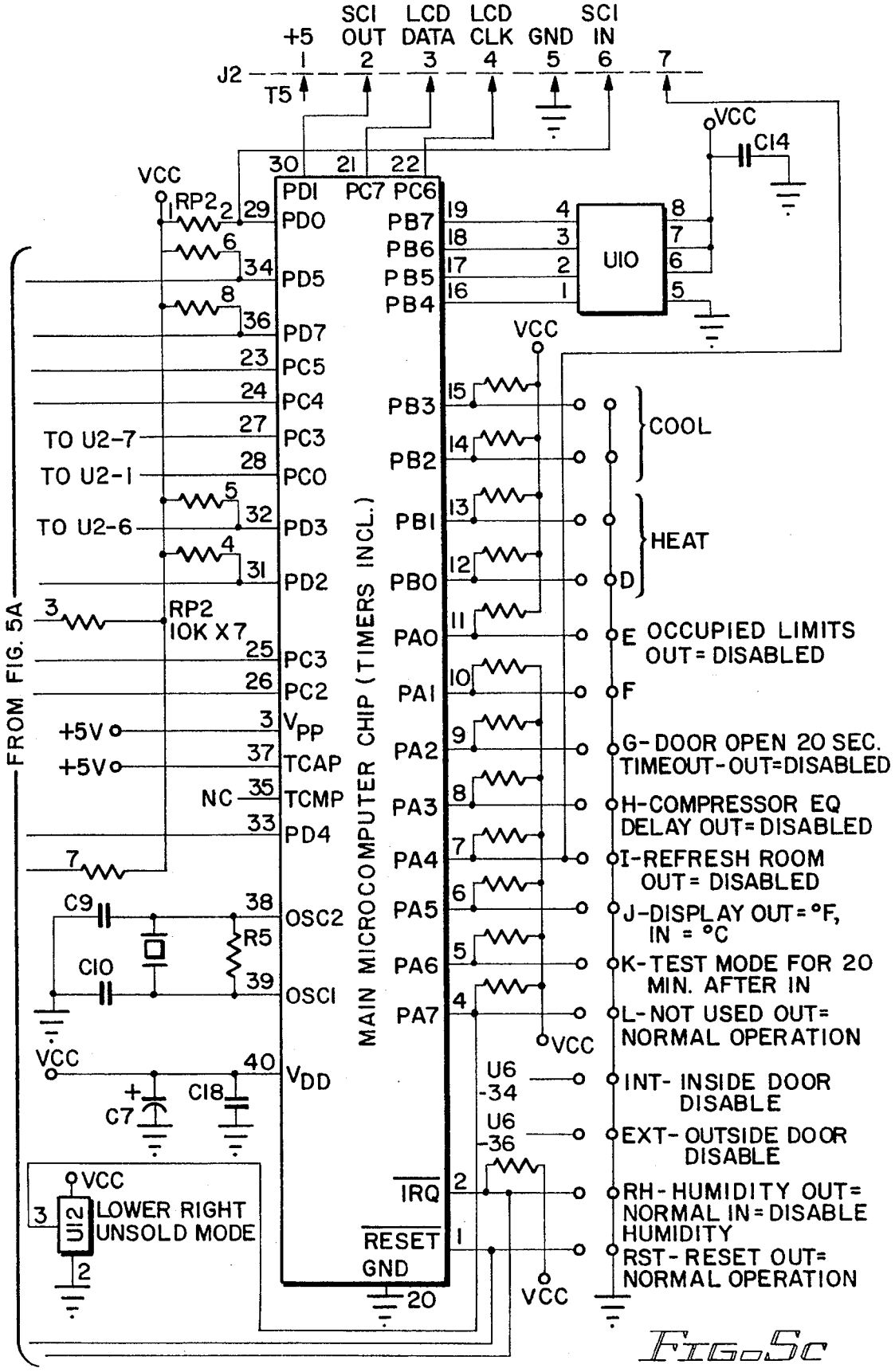

The controller 10 therefore comprises an algorithm logic which saves energy and retards growth of mold and mildew. Such a controller is of particular interest where high humidity and warm temperatures exist for extended periods of time. In addition, it is anticipated that a data communications link 33 (e.g., RS485 and RS232) currently available on HVAC systems will be used to receive the psychrometric information provided by the controller 10 for communicating such information and adjusting the HVAC system operating mode accordingly for either dry or damp cycle effectiveness. By such use of available data, the time out clock is not necessary. FIG. 5 includes a schematic circuit diagram illustrating the preferred embodiment of the electronics used to meet the needs of the functional requirements described and illustrated in FIGS. 1 and 3.

While a specific embodiment of the invention has been described in detail herein above, it is to be understood that various modifications may be made from the specific details described herein without departing from the spirit and scope of the invention as set forth in the appended claims.

What is claimed is:

1. A system for controlling HVAC in an enclosed space, the system comprising:

means for determining occupancy status of an enclosed space and delivering a signal indicating an unoccupied condition;

means for sensing temperature in the space and providing a signal corresponding to the sensed temperature;

means for sensing humidity in the space and providing a signal corresponding to the sensed humidity;

means for comparing the sensed temperature to a predetermined temperature and providing first and second temperatures enabling the condition signals representative of differences between the sensed and predetermined temperatures;

means for comparing the sensed humidity to a predetermined humidity and providing first and second enabling condition signals representative of differences between the sensed and predetermined humidity;

means for enabling the HVAC for bringing the room temperature and humidity to the predetermined temperature and humidity, the enabling means responsive to the unoccupied condition signal in combination with one of the temperature enabling condition signals in combination with one of the humidity enabling condition signals.

2. The control system as recited in claim 1, further comprising means for providing a lapsed time period signal, the lapsed time period signal initiated by the unoccupied condition signal, for starting a predetermined time period the predetermined time period, providing a third enabling condition signal when the predetermined lapsed time period has lapsed.

3. The control system as recited in claim 1, wherein the HVAC enabling means comprises a thermostat for setting the predetermined temperature and monitoring the space temperature, the thermostat providing a forth enabling condition signal when the space temperature exceeds the predetermined temperature.

4. The control system as recited in claim 1, wherein the occupancy status means comprises a motion detector operating in combination with a space entrance door closed condition for providing the unoccupied condition signal.

5. The control system as recited in claim 1, further comprising means for providing a communications signal, the communications signal representative of psychrometric data sensed by the control system and processed by a control system microcomputer.

6. The control system as recited in claim 1, wherein the HVAC enabling means comprises an HVAC control relay, the relay communicating with a microcomputer for receiving enabling and disabling signals.

7. The control system as recited in claim 1, further comprising means for providing a control relay signal, the control relay signal representative of psychrometric data sensed by the control system for providing control of an auxiliary room support system.

8. The control system as recited in claim 7, wherein the auxiliary system is selected from the group consisting of dehumidifiers, water heater and lighting systems.

9. The control system as recited in claim 1, where the comparing means further comprise a microcomputer having logic software for receiving psychrometric data and providing the enabling signals.

10. A method for controlling an enclosed space environment, the method comprising the steps of:

determining occupancy status of an enclosed space and delivering a signal indicating an unoccupied condition;

sensing temperature in the space and providing a signal corresponding to the sensed temperature;

sensing humidity in the space and providing a signal corresponding to the sensed humidity;

comparing the sensed temperature to a predetermined temperature and providing first and second temperature enabling condition signals representative of differences between the sensed and predetermined temperatures;

comparing the sensed humidity to a predetermined humidity and providing first and second humidity enabling condition signals representative of differences between the sensed and predetermined humidity; and enabling an HVAC system cooperating with the space for bringing the enclosed space temperature and the enclosed space humidity to a predetermined temperature and humidity, the enabling step responsive to the unoccupied condition signal in combination with one of the temperature enabling condition signals in combination with one of the humidity enabling condition signals.

11. The method as recited in claim 10, further comprising the step of providing a lapsed time period signal, the lapsed time period signal initiated by the unoccupied condition signal for starting a predetermined time period, the predetermined time period providing a third enabling condition signal when the predetermined time period has lapsed.

12. The method as recited in claim 10, wherein the step of enabling the HVAC system comprises the steps of:

setting a thermostat to the predetermined temperature;

monitoring the enclosed space temperature; and providing a forth enabling condition signal when a space environment extends beyond a predetermined environmental boundary.

13. The method as recited in claim 10, wherein the step of determining occupancy status comprises the step of operating a motion detector in combination with a space entrance door closed condition for providing the unoccupied condition signal.

14. A method for controlling a room HVAC system comprising the steps of:

determining occupancy status of a room serviced by an HVAC system and providing an unoccupied signal representative of the unoccupied status;

starting a clock with the unoccupied signal;

monitoring the clock and providing a lapsed time signal representative of time on the clock exceeding a preset time;

monitoring room temperature;

comparing the room temperature to a predetermined setback temperature and providing a low temperature signal representative of the room temperature being less than the predetermined setback temperature and a setback temperature signal representative of the room temperature being at least the predetermined setback temperature;

monitoring room humidity;

comparing the room humidity to a predetermined humidity and providing a dry signal when the room humidity is less than the predetermined humidity and a damp signal when the room humidity is at least the predetermined humidity;

enabling the HVAC system for reducing the room temperature proximate to and less than the setback temperature in response to the unoccupied, setback temperature and dry signals;

enabling the HVAC system until one of the low temperature, dry and lapsed time signals is received, the enabling in response to the unoccupied, setback temperature and damp signals;

disabling the HVAC system by resetting the clock with an increased preset time in response to the lapsed time signal;

disabling the HVAC system by resetting the clock with the preset time in response to one of the low temperature and dry signals;

resetting the clock with the increased preset time in response to the unoccupied, lapsed time and dry signals;

enabling the HVAC system until one of the low temperature, dry and lapsed time signals is received, the enabling in response to the unoccupied, low temperature and damp signals;

disabling the HVAC system by resetting the clock with an increased preset time in response to the lapsed time signal;

disabling the HVAC system by resetting the clock with the preset time in response to one of the low temperature and dry signals; and continuing the monitoring of the room occupancy, temperature and humidity for cycling through the above steps of enabling and disabling the HVAC system for efficiently bringing the room temperature and humidity to predetermined levels outside a mold and mildew growth environment.

15. The method as recited in claim 14 wherein the step of determining the occupancy status further comprises the step of operating a motion detector in combination with a room entrance door closed condition for providing the unoccupied signal.

16. The method as recited in claim 14, wherein the step of providing the lapsed time signal results from exceeding a one hour preset time and the step of resetting the clock with the increased preset time comprises setting a two hour increased preset time.

17. The method as recited in claim 14, wherein the room temperature comparing step comprises the step of comparing the room temperature to a 72° F. setback temperature, the setback temperature corresponding to a temperature below which mold and mildew growth is retarded.

18. The method as recited in claim 14, wherein the humidity comparing step comprises the step of comparing the room humidity to a 60% predetermined relative humidity, predetermined humidity corresponding to a relative humidity below which mold and mildew growth is retarded.

19. The method as recited in claim 14, wherein the temperature comparing step further comprises the steps of:

providing a thermostat communicating with the HVAC system for enabling and disabling the system; and selecting a thermostat temperature setting at the predetermined setback temperature for providing the setback temperature signal.

20. The method as recited in claim 14, wherein the room temperature proximate to and less than the setback temperature is a 2° F. temperature differential for causing efficient use of the HVAC system in reducing the room temperature.

* * * * *